US006716085B2

(12) United States Patent
Wiswesser et al.

(10) Patent No.: US 6,716,085 B2
(45) Date of Patent: Apr. 6, 2004

(54) POLISHING PAD WITH TRANSPARENT WINDOW

(75) Inventors: Andreas Norbert Wiswesser, Mountain View, CA (US); Boguslaw A. Swedek, San Jose, CA (US)

(73) Assignee: Applied Materials Inc., Santa Clara, CA (US)

( * ) Notice: Subject to any disclaimer, the term of this patent is extended or adjusted under 35 U.S.C. 154(b) by 0 days.

(21) Appl. No.: 10/035,391

(22) Filed: Dec. 28, 2001

(65) Prior Publication Data

US 2003/0124956 A1 Jul. 3, 2003

(51) Int. Cl.[7] ..... B24B 49/12

(52) U.S. Cl. ..... 451/6; 451/8; 451/285; 451/287; 451/526; 156/345.11; 156/636.1; 438/5

(58) Field of Search ..... 451/5, 6, 8, 41, 451/9, 36, 285, 37, 283, 286, 287–290, 526; 156/636.1, 626, 345.11–345.15; 437/7, 225; 438/5, 7, 8, 691–693

(56) References Cited

U.S. PATENT DOCUMENTS

| | | | | |
|---|---|---|---|---|
| 5,081,796 | A | | 1/1992 | Schultz |
| 5,196,353 | A | | 3/1993 | Sandhu et al. |
| 5,257,478 | A | | 11/1993 | Hyde et al. |
| 5,265,378 | A | | 11/1993 | Rostoker |
| 5,413,941 | A | | 5/1995 | Koos et al. |
| 5,433,651 | A | | 7/1995 | Lustig et al. |
| 5,489,233 | A | | 2/1996 | Cook et al. |
| 5,605,760 | A | | 2/1997 | Roberts |
| 5,609,511 | A | | 3/1997 | Moriyama et al. |
| 5,672,091 | A | | 9/1997 | Takahashi et al. |
| 5,838,417 | A | | 11/1998 | Dahan et al. |
| 5,872,633 | A | | 2/1999 | Holzapfel et al. |
| 5,893,796 | A | | 4/1999 | Birang et al. |
| 5,949,927 | A | | 9/1999 | Tang |
| 6,014,218 | A | * | 1/2000 | Bradl et al. ..... 356/630 |
| 6,045,439 | A | | 4/2000 | Birang et al. |
| 6,071,177 | A | * | 6/2000 | Lin et al. ..... 451/6 |
| 6,171,181 | B1 | | 1/2001 | Roberts et al. |
| 6,224,460 | B1 | * | 5/2001 | Dunton et al. ..... 451/6 |
| 6,280,290 | B1 | | 8/2001 | Birang et al. |
| 6,315,917 | B1 | * | 11/2001 | Shieh ..... 216/85 |
| 6,358,130 | B1 | | 3/2002 | Freeman et al. |
| 6,399,501 | B2 | * | 6/2002 | Birang et al. ..... 438/692 |
| 6,454,630 | B1 | * | 9/2002 | Tolles ..... 451/6 |
| 6,459,514 | B2 | * | 10/2002 | Gilbert et al. ..... 359/15 |
| 6,517,417 | B2 | | 2/2003 | Budinger et al. ..... 451/41 |
| 2001/0031610 | A1 | | 10/2001 | Budinger et al. ..... 451/41 |
| 2001/0036805 | A1 | | 11/2001 | Birang et al. |

FOREIGN PATENT DOCUMENTS

| | | |
|---|---|---|
| EP | 468 897 | 1/1992 |
| EP | A 0663265 | 7/1995 |
| EP | 0738561 A1 | 10/1996 |

(List continued on next page.)

*Primary Examiner*—Joseph J. Hail, III
*Assistant Examiner*—Anthony Ojini
(74) *Attorney, Agent, or Firm*—Fish & Richardson

(57) ABSTRACT

A polishing solution is dispensed onto a polishing pad that has a polishing surface, a substrate is brought into contact with the polishing surface, relative motion is created between the substrate and the polishing pad, a light beam is directed through a window in the polishing pad to impinge the substrate, and an intensity of a reflected light beam from the substrate is monitored. The polishing solution has a first refractive index, and the window has a second index of refraction that is approximately equal to the first index of refraction.

23 Claims, 3 Drawing Sheets

FOREIGN PATENT DOCUMENTS

| | | | |
|---|---|---|---|
| EP | 0881040 | A2 | 2/1998 |
| EP | 0881484 | A2 | 2/1998 |
| FR | A 1075634 | | 10/1954 |
| JP | 53-9558 | | 1/1978 |
| JP | 58-4353 | | 1/1983 |
| JP | 62-211927 | | 9/1987 |
| JP | 2-222533 | | 9/1990 |
| JP | 3-234467 | | 10/1991 |
| JP | 07-052032 | | 2/1995 |
| JP | 9-36072 | | 1/1997 |
| WO | WO 97/06921 | | 2/1997 |
| WO | WO 01/12387 | | 2/2001 |

* cited by examiner

POLISHING PAD WITH TRANSPARENT WINDOW

BACKGROUND

This invention relates generally to semiconductor device manufacture, and more particularly to a window in a polishing pad for use in chemical mechanical polishing (CAMP).

In the process of fabricating modem semiconductor integrated circuits (IC), it is necessary to form various material layers and structures over previously formed layers and structures. However, the underlying features can leave the top surface topography of an in-process substrate highly irregular, with bumps, areas of unequal elevation, troughs, trenches, and/or other surface irregularities. These irregularities cause problems in the photolithographic process. Consequently, it is desirable to effect some type of planarization of the substrate.

One method for achieving semiconductor substrate planarization or topography removal is chemical mechanical polishing (CAMP). A conventional chemical mechanical polishing (CAMP) process involves pressing a substrate against a rotating polishing pad in the presence of an abrasive slurry.

In general, there is a need to detect when the desired surface planarity or layer thickness has been reached or when an underlying layer has been exposed in order to determine whether to stop polishing. Several techniques have been developed for the in-situ detection of endpoints during the CAMP process. For example, an optical monitoring system for in-situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CAMP systems, the light beam is directed toward the substrate through a window in the polishing pad. A layer of slurry is typically present between the substrate and an upper surface of the window.

SUMMARY

In one aspect, the invention is directed to a system for polishing a substrate. The system has a polishing pad with a polishing surface, a polishing head to hold the substrate against the polishing pad during polishing, a layer of slurry on the polishing pad, a window formed in the polishing pad, and an optical monitoring system including a light source and a detector. The slurry has a first refractive index, and the window has a second refractive index close to the first refractive index of the slurry. The optical monitoring system is capable of generating a light beam and is arranged to direct the light beam during at least part of the polishing operation through the window to impinge on the substrate.

Implementations of the invention may include one or more of the following features. The second refractive index may be sufficiently close to the first refractive index that scratches on the window's upper surface do not increase reflection or scattering of the light beam at the interface with the slurry. The second refractive index may be within about 0.07 of the first refractive index, or within about 0.045 of the first refractive index, or within about 0.03 of the first refractive index, or within about 0.01 of the first refractive index. The second refractive index may be in the range of 1.26 to 1.4. The second refractive index may be within 5.5% of the first refractive index, e.g., within 1.0% of the first refractive index. The window may be comprised of an optically clear material with negligible diffusing capabilities. The material may be silicone. The may be a fluoropolymer, such as poly(pentadecafluorooctylacrylate), poly(tetrafluoroethylene), poly(undecafluororexylacrylate), poly(nonafluropentylacrylate), poly(heptafluorobutylacrylate), or poly(trifluorovinylacetate). The polishing pad may have an upper portion and a lower portion, and the window may be formed in the upper portion of the polishing pad. A base window may be formed in the lower portion of the polishing pad directly beneath the window. The base window may be made of glass. The window may be tapered to have dimensions that increase away from the polishing surface.

In another aspect, the invention is directed to a polishing pad. The polishing pad has a layer with a polishing surface and a window formed in the layer that has a refractive index close to a refractive index of a polishing solution.

In another aspect, the invention is directed to a method of polishing a substrate. The method includes dispensing a polishing solution onto a polishing pad that has a polishing surface, bringing a substrate into contact with the polishing surface, creating relative motion between the substrate and the polishing pad, directing a light beam through a window in the polishing pad to impinge the substrate, and monitoring an intensity of a reflected light beam from the substrate. The polishing solution has a first refractive index, and the window has a second index of refraction that is approximately equal to the first index of refraction.

Potential advantages of the invention may include one or more of the following. The window may be formed out of an optically clear material with negligible diffusing capabilities with improved transparency. Scattering and reflecting of the light beam at the upper surface of the window due to scratches and irregularities may be reduced. Furthermore, reflection of the light beam at the interface between the window and the slurry may be reduced. Consequently the window may improve the signal-to-noise ratio in the signal from the detector. In addition, slurry leakage around the perimeter of the window is minimized by the configuration of the window in the polishing pad.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

Figure 1:
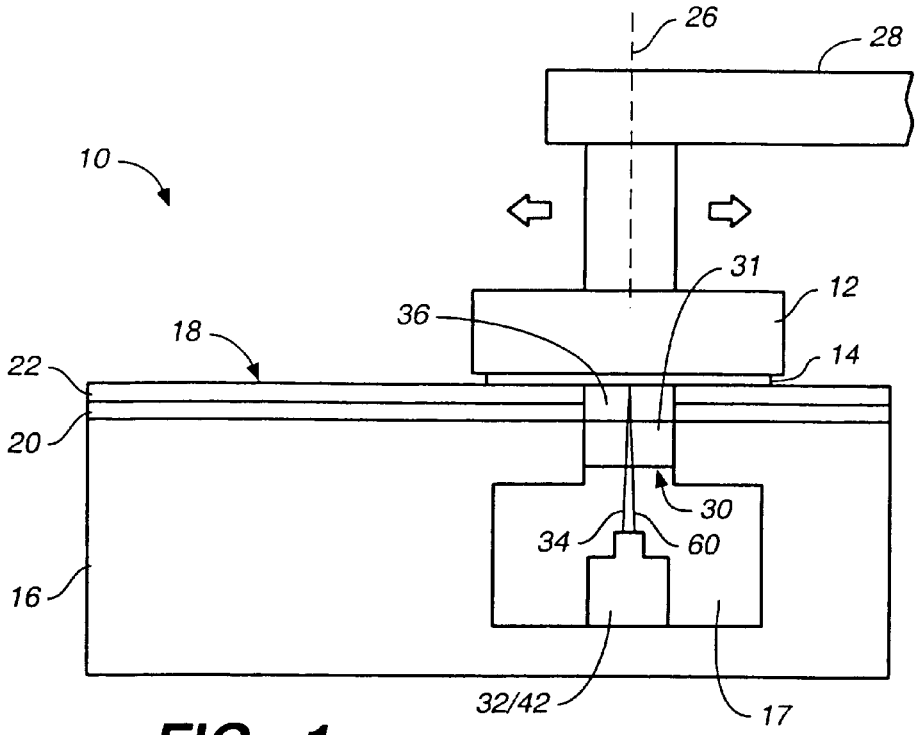
FIG. 1 is a cross-sectional side view of a chemical mechanical polishing apparatus with an optical monitoring system for endpoint detection.
Figure 2:
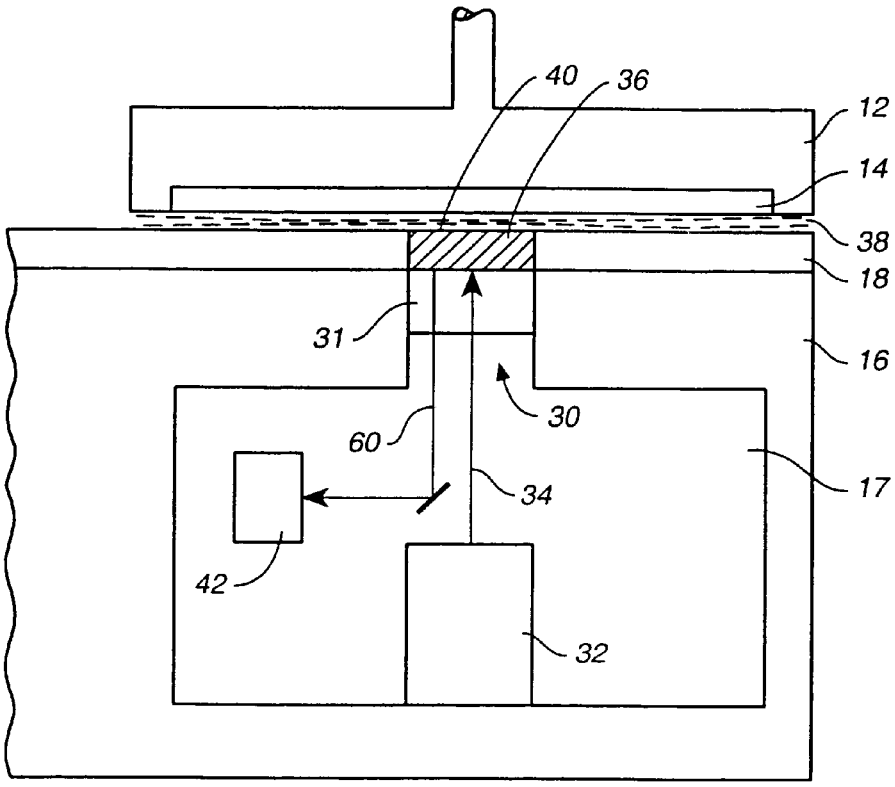
FIG. 2 is a simplified cross-sectional view of a portion of the apparatus of FIG. 1.

As shown in FIGS. 1 and 2, the CAMP apparatus 10 includes a polishing head 12 for holding a semiconductor substrate 14 against a polishing pad 18 on a platen 16. The CAMP apparatus may be constructed as described in U.S. Pat. No. 5,738,574, the entire disclosure of which is incorporated herein by reference.

This polishing pad 18 can be a two-layer pad with a backing layer 20 that interfaces with the surface of the platen 16 and a covering layer 22 with a polishing surface to contact the substrate. The covering layer 22 can be a durable rough layer (e.g., Rodel IC-1000), whereas the backing layer can be a more compressible layer (e.g., Rodel Suba-IV). However, some pads have only a covering layer and no backing layer. Alternatively, the polishing pad can be a fixed-abrasive pad with abrasive particles held in a containment media.

Typically the polishing pad material is wetted with the chemical polishing solution or slurry with a chemically reactive agent, and, assuming a "standard" polishing pad, abrasive particles. For example, the slurry can include KOH (Potassium Hydroxide) and fumed-silica particles. However, some polishing processes are "abrasiveless".

The polishing head 12 applies pressure to the substrate 14 against the polishing pad 18 as the platen rotates about its central axis 24. In addition, the polishing head 12 is usually rotated about its central axis 26, and translated across the surface of the platen 16 via a translation arm 28. However, it is also possible for the polishing system to use a linear belt, for just the polishing pad or the substrate to move, or for the polishing surface or the substrate to undergo different types of motion. The pressure and relative motion between the substrate and the polishing surface, in conduction with the polishing solution, result in polishing of the substrate.

A hole 30 is formed in the top surface of the platen 16 and is aligned with a window 36 formed in the overlying polishing pad 18. At least part of the hole 30 can be filled with a transparent solid piece 31, such as a quartz block. The hole 30 and the window 36 are positioned such that they have a view of the substrate 14 held by the polishing head 12 during a portion of the platen's rotation, regardless of the translational position of the head 12.

An optical monitoring system, including a light source 32, such as a laser, and a detector 42, such as a photodetector, is fixed below the top surface of the platen 16. For example, the optical monitoring system can be located in a recess or space 17 inside the platen 16 and can rotate with the platen. Alternatively, the optical monitoring system could be a stationary system located below the platen. The light source 32 projects a light beam 34 through the aperture 30 and the window 36 in the polishing pad 18 to strike the surface of the overlying substrate 14 at least during a time when the window 36 is adjacent the substrate 14. Light reflected from the substrate forms a resultant beam 60 that is detected by the detector 42. An unillustrated computer receives the measured light intensity from the detector 42 and uses it to determine the polishing endpoint, e.g., by detecting a sudden change in the reflectivity of the substrate that indicates the exposure of a new layer, by calculating the thickness removed from of the outer layer (such as a transparent oxide layer) using interferometric principles, or by monitoring the signal for predetermined endpoint criteria.

Slurry applied to the polishing pad 18 during the polishing operation can form a layer 38 between the substrate 14 and the polishing pad 18, including the upper surface of the window 36. However, the interface between the window 36 and the polishing pad 18 is sealed, so that the slurry 38 cannot leak through to the platen 16.

Due to the proximity of the upper surface of the window 36 to the substrate and carrier head 12, scratches and other irregularities tend to accumulate on the upper surface during the life of the window. The scratches and irregularities on the upper surface cause scattering and reflection at the window-slurry interface, thus attenuating the light beam and increasing the signal-to-noise ratio in the signal from the detector 42. Accordingly, although this system works, there is still room for improvement of the signal-to-noise ratio. This may be particularly true where the monitoring system uses small changes in the intensity of the reflected light beam, such as where the monitoring system functions as an interferometer.

Figure 3:
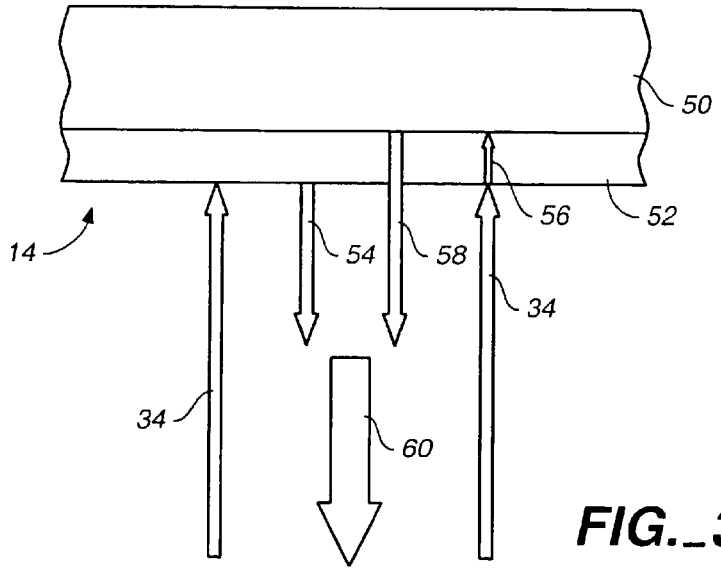
FIG. 3 is a simplified schematic view showing components of a light beam impinging on and reflecting off a substrate.

Referring to FIG. 3, assuming that oxide polishing is being performed, the substrate 14 as will include a silicon wafer 50 and an overlying oxide layer 52 (other intervening layers may also be present, but are omitted for simplicity). The portion of the light beam 34 that impinges on the substrate 14 will be partially reflected at the surface of the oxide layer 52 to form a first reflected beam 54. However, a portion of the light will also be transmitted in beam 56 through the oxide layer 52 and reflect from the underlying layer or wafer 50 to form a second reflected beam 58. The first and second reflected beams 54, 58 interfere with each other constructively or destructively depending on their phase relationship, to form the resultant beam 60, where the phase relationship is primarily a function of the thickness of the oxide layer 52. The intensity of the resultant beam 60 is analyzed to determine the thickness of the oxide layer 52 using techniques known in the art. In one implementation the optical monitoring system comprises an interferometer capable of generating a collimated light beam and an interference signal, as described in U.S. Pat. No. 5,964,643, the entire disclosure of which is incorporated herein by reference.

Figure 4A:
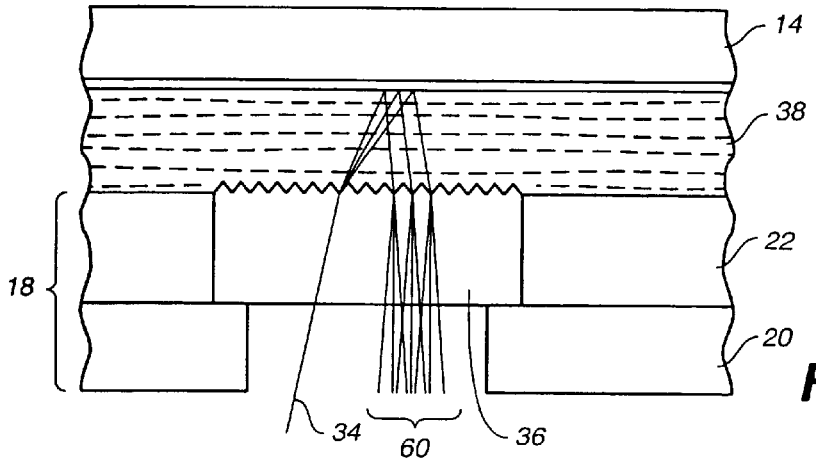
FIG. 4A is a simplified cross-sectional view of a window in a polishing pad.

Without being limited to any particular theory, one possible source of attenuation is scattering of the light beam at the interface between the window 36 and the slurry 38. As shown in FIG. 4A, if the window 36 has scratches or surface roughness, both the outgoing light beam 34 and the incoming light beam 60 can be scattered at the window-slurry interface 40. This scattering can increase the signal-to-noise ratio.

Refraction is the bending of light as the light passes from one medium to another when there is a difference in the index of refraction between the two mediums. When the two refractive indices of two mediums are equal the light passes from the first medium to the second medium without refraction.

Figure 4B:
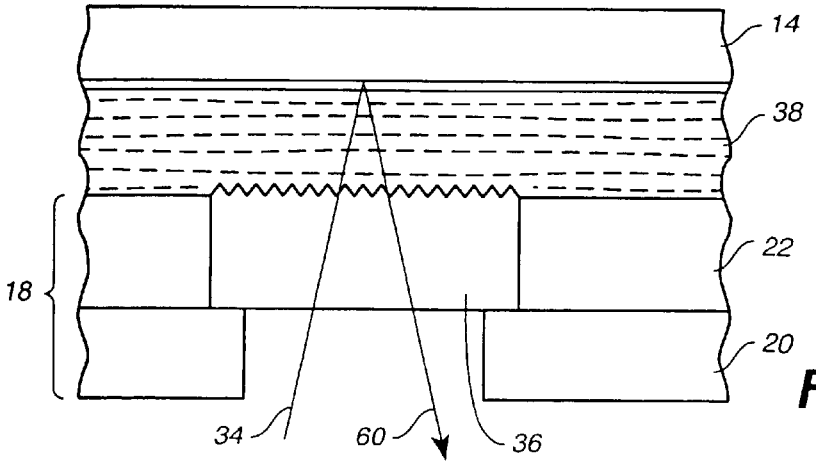
FIG. 4B is a simplified cross-sectional view of a window in a polishing pad from the apparatus of FIG. 1, constructed in accordance with the present invention.

Referring to FIG. 4B, the window 36 can be formed from a material having a refractive index equal to, or nearly equal to, the refractive index of the slurry 38, at the wavelengths of interest to the optical monitoring system (e.g., if the light source 32 is a laser, then at the wavelength of the beam 34 emitted by the laser). Thus, the light beam 34 can pass from the window 36 into the slurry 38 without refraction. Accordingly, the window 36 and the slurry 38 essentially behave as a single medium for the purpose of transmitting the light beam 34 from the light source 32 to the overlying substrate 14. As a result, irregularities on the surface of the window 36, including scratches, do not tend to scatter the light beam 34 at the window-slurry interface 40.

As shown, if the window 36 and the slurry 38 have equal, or close to equal, refractive indices, the light beam 34 propagates through the slurry 38 without refraction, is reflected off the surface of the substrate 14 and again propagates through the slurry 38 and into the window 36 without refraction. Because the window-slurry interface 40 is non-existent from the perspective of the light beam 34, irregularities on the upper surface of the window 36 do not promote scattering of the light beam 34 upon exiting or entering the window 36. As a result, the signal-to-noise ratio is improved, thus improving the accuracy of the optical monitoring system.

In one implementation the light source 32 can be an interferometer and the light beam 34 can be a laser beam. It is feasible to employ a wavelength anywhere from the far infrared to ultraviolet. Typically, a laser that emits red light is used. A shorter wavelength results in an increase in the amount of scattering. However, longer wavelengths result in more of the oxide layer being removed per period of the interference signal. It is desirable to remove as little of the material as possible during each period so that optical monitoring system has a high precision and the possibility of any excess material being removed is minimized. It is believed these two competing factors in the choice of wavelength are balanced if a red light laser beam is chosen. Red light offers an acceptable degreed of scattering without an unmanageable amount of material being removed per cycle.

Typical slurry used in a CAMP operation is comprised largely of water and has a refractive index of approximately 1.33 in the visible spectrum. For example, the refractive index of a typical slurry when using a red light is approximately 1.331. Accordingly, the material selected to form the window 36 should have a refractive index equal to, or nearly equal to, 1.331 when using a red light. The material should also be optically clear with negligible diffusing capabilities to allow optimal transmission of the laser beam. In addition, the material needs to be chemically compatible with the slurry and substrate composition.

In one implementation the window 36 can be formed from silicone.

In another implementation the window 36 can be formed from a fluorothermoplastic having a refractive index within 0.03 of the refractive index of the slurry. The following fluorothermoplastics manufactured by Dyneon™ LLC of Oakdale, Minn., have a refractive index of about 1.34 and are therefore potential materials to form a window for use with a typical slurry having a refractive index of 1.33: FEP X 6301, FEP X 6303, FEP X 6307 and FEP X 6322, PFA 6502 N, PFA 6505 N, PFA 6510 N and PFA 6515 N. FEP is a polymer of tetrafluoroethylene and hexafluoropropylene and PFA is a polymer of tetrafluoroethylene and perfluorovinylether.

In another implementation, the window 36 can be formed of a polymer having a refractive index within 0.045 of the refractive index of the slurry. The following polymers are potential candidates to form a window for use with a typical slurry having a refractive index of 1.33:

| | |
|---|---|
| Poly (pentadecafluorooctylacrylate) | refractive index = 1.339 |
| Poly tetrafluoroethylene | refractive index = 1.350 |

-continued

| | |
|---|---|
| Poly (undecafluororexylacrylate) | refractive index = 1.356 |
| Poly (nonafluropentylacrylate) | refractive index = 1.360 |
| Poly (heptafluorobutylacrylate) | refractive index = 1.367 |
| Poly (trifluorovinylacetate) | refractive index = 1.375 |

In addition to the refractive index and optical clarity, the hardness and flexibility of the material selected to form the window 36 can be important characteristics. The material should be hard enough to resist scratching and flexible enough to resist breakage under the frictional and compressive forces applied by the substrate.

Still referring to FIG. 4B, the window 36 can be a cylindrical or rectangular plug formed in the covering layer 22, and an aperture 48 can be formed in the backing layer 20. For example, a two-part aperture can be cut into the polishing pad, with the dimensions of the aperture in the backing layer 20 being smaller than the dimensions of the aperture in the covering layer 22. The window 36 can be secured in the portion of the aperture in the covering layer 22, e.g., with adhesive, leaving a gap in the backing layer 20. Alternatively, it may be possible for the window 36 to be integrally molded into the covering layer 22.

Figure 5:
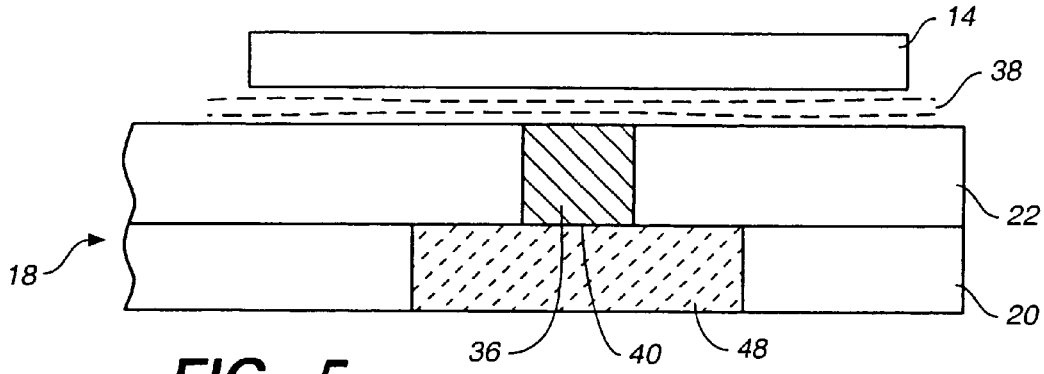
FIG. 5 is a simplified cross-sectional view of another implementation of a window in a polishing pad.

FIG. 5 shows another implementation in which a base window 48 is formed in the backing layer 20 of the polishing pad 18. The base window 48 also can be a cylindrical or rectangular plug, and can have dimensions greater than the dimensions of the window 36. Thus, the base window 48 can form a base to hold the window 36 in place in the covering layer 22 of the polishing pad 18. The base window 48 can be formed from glass. Since the base window 48 is not exposed to slurry, it should not be scratched, and consequently it does not need to match the refractive index of the slurry 38. Optionally, the bottom surface of the base window 48 can have a diffuse lower surface. In yet another implementation, the base window 48 can be a projection from the transparent block 31 in the platen 16.

Figure 6:
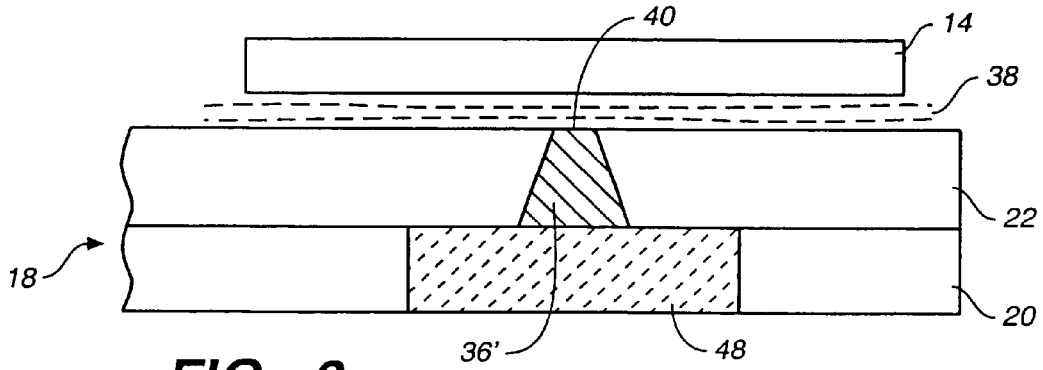
FIG. 6 is a simplified cross-sectional view of another implementation of a window in a polishing pad.

FIG. 6 shows another implementation in which the window 36' is tapered so that its dimensions (length and width if it is a rectangular plug, or diameter if it is a cylindrical plug) increases with the distance from the window-slurry interface 40. An advantage of this implementation is that it reduces the surface area of the window 36' in contact with the substrate, so that the window 36' undergoes less abrasion and is less likely to break. This implementation can be used with a polishing pad 18 having a backing layer 20 and a covering layer 22, and with a base window 48 formed in the backing layer 20.

Figure 7:
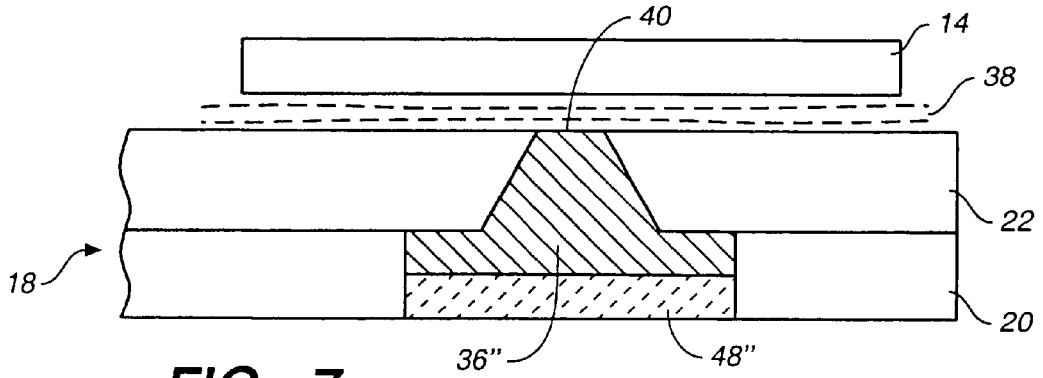
FIG. 7 is a simplified cross-sectional view of another implementation of a window in a polishing pad.

FIG. 7 shows another implementation in which the window 36" includes a tapered section 70 in the covering layer 22 and a flat section 72 that extends into the aperture in the backing layer 20. This implementation can also include a base window 48", although this base window 48" may be thinner than the backing layer 20.

Although the above-described embodiment employs a silicon substrate with a single oxide layer, those skilled in the art will recognize that the interference process would also occur with other substrates and other layers. The key for an interference process is that a layer partially reflects and partially transmit the impinging beam. In addition, the invention may also be useful for purely reflective monitoring, e.g., of metal layers.

A number of embodiments of the invention have been described. Nevertheless, it will be understood that various modifications may be made without departing from the spirit and scope of the invention. Accordingly, other embodiments are within the scope of the following claims.

What is claimed is:

1. A system for polishing a substrate, comprising:

a polishing pad having a polishing surface;

a polishing head to hold the substrate against the polishing pad during polishing;

a layer of slurry on the polishing pad, the slurry having a first refractive index;

a window formed in the polishing pad, the window having a second refractive index close to the first refractive index of the slurry and the window being formed of material selected from the group consisting of silicone, poly (heptafluorobutylacrylate), and poly (trifluorovinylacetate); and an optical monitoring system including a light source and a detector, the optical monitoring system capable of generating a light beam and arranged to direct the light beam during at least part of the polishing operation through the window to impinge on the substrate.

2. The system of claim 1, wherein the second refractive index is sufficiently close to the first refractive index such that scratches on an upper surface of the window will not increase reflection or scattering of the light beam at an interface of the window's upper surface with the slurry.

3. The system of claim 1, wherein the second refractive index is within about 0.07 of the first refractive index.

4. The system of claim 3, wherein the second refractive index is within about 0.045 of the first refractive index.

5. The system of claim 4, wherein the second refractive index is within about 0.03 of the first refractive index.

6. The system of claim 5, wherein the second refractive index is within about 0.01 of the first refractive index.

7. The system of claim 1, wherein the second refractive index is in the range of 1.26 to 1.4.

8. The system of claim 1, wherein the second refractive index is within 5.5% of the first refractive index.

9. The system of claim 8, wherein the second refractive index is within 1.0% of the first refractive index.

10. The system of claim 1, wherein the window is comprised of an optically clear material with negligible diffusing capabilities.

11. The system of claim 1, wherein the polishing pad has an upper portion and a lower portion and the window is formed in the upper portion of the polishing pad.

12. The system of claim 11, further comprising a base window formed in the lower portion of the polishing pad directly beneath the window and forming a base holding the window in place.

13. The system of claim 12, wherein the base window is made of glass.

14. The system of claim 11, wherein the window is tapered to have dimensions that increase with distance away from the polishing surface.

15. A polishing pad, comprising:

a layer having a polishing surface;

a window formed in the layer that has a refractive index close to a refractive index of a polishing solution, the window being formed of material selected from the group consisting of silicone, poly (heptafluorobutylacrylate) and poly (trifluorovinylacetate).

16. A method of polishing a substrate, comprising:

dispensing a polishing solution having a first refractive index onto a polishing pad that has a polishing surface;

bringing a substrate into contact with the polishing surface of the polishing pad;

creating relative motion between the substrate and the polishing pad;

directing a light beam through a window in the polishing pad to impinge the substrate, the window having a second index of refraction that is approximately equal to the first index of refraction and the window being formed of material selected from the group consisting of silicone, poly (heptafluorobutylacrylate), and poly (trifluorovinylacetate); and monitoring an intensity of a reflected light beam from the substrate.

17. A polishing pad, comprising:

a polishing layer having a polishing surface; and a solid window of transparent material in the polishing layer, wherein the material is selected from the group consisting of silicone, poly (heptafluorobutylacrylate), and poly (trifluorovinylacetate).

18. The polishing pad of claim 17, wherein the material has an index of refraction of between about 1.26 to 1.4.

19. The polishing pad of claim 18, wherein the material has an index of refraction of between about 1.33 to 1.8.

20. The polishing pad of claim 19, wherein the material has an index of refraction of about 1.34.

21. A polishing pad, comprising:

a polishing layer having a polishing surface; and a solid window of transparent material in the polishing layer, wherein the material has an index of refraction of between about 1.26 to 1.4 and the material is selected from the group consisting of silicone, poly (heptafluorobutylacrylate), and poly (trifluorovinylacetate).

22. The polishing pad of claim 21, wherein the material has an index of refraction of between about 1.33 to 1.38.

23. The polishing pad of claim 22, wherein the material has an index of refraction of about 1.34.

* * * * *

UNITED STATES PATENT AND TRADEMARK OFFICE

CERTIFICATE OF CORRECTION

PATENT NO. : 6,716,085 B2
DATED : April 6, 2004
INVENTOR(S) : Wiswesser et al.

It is certified that error appears in the above-identified patent and that said Letters Patent is hereby corrected as shown below:

Title page,
Item [*] Notice, please delete and insert the following:
-- Subject to any disclaimer, the term of this patent is extended or adjusted under 35 U.S.C 154(b) by 21 days. --

Signed and Sealed this

Twenty-eighth Day of June, 2005

JON W. DUDAS
*Director of the United States Patent and Trademark Office*